United States Patent [19]

Pinson

[11] 4,455,943

[45] Jun. 26, 1984

[54] MISSILE DEPLOYMENT APPARATUS

[75] Inventor: George T. Pinson, Huntsville, Ala.

[73] Assignee: The Boeing Company, Seattle, Wash.

[21] Appl. No.: 295,164

[22] Filed: Aug. 21, 1981

[51] Int. Cl.[3] ..... F42B 15/00; F42B 13/28; F42B 13/50

[52] U.S. Cl. ..... 102/489; 102/393

[58] Field of Search ..... 102/489, 351, 393, 703; 89/1.5 R

[56] References Cited

U.S. PATENT DOCUMENTS

| | | | |
|---|---|---|---|
| 2,372,804 | 4/1945 | Vertzinsky | 102/405 |
| 2,376,227 | 5/1945 | Brown | 102/383 |
| 2,379,257 | 6/1945 | Scott | 102/383 |
| 2,925,965 | 2/1960 | Pierce | 343/6 ND |
| 3,461,801 | 8/1969 | Vitale et al. | 102/489 |
| 3,730,098 | 5/1973 | Edwards | 102/351 |
| 3,899,975 | 8/1975 | Lawrence | 102/505 |
| 3,938,442 | 2/1976 | Donadio | 102/494 |
| 3,954,060 | 5/1976 | Haag et al. | 102/494 |
| 3,956,990 | 5/1976 | Rowe | 102/494 |
| 3,998,162 | 12/1976 | Forrest et al. | 102/476 |
| 4,178,854 | 12/1979 | Schillreff | 102/89 |
| 4,210,082 | 7/1980 | Brothers | 102/8 |

FOREIGN PATENT DOCUMENTS

| | | | |
|---|---|---|---|
| 2146356 | 9/1972 | Fed. Rep. of Germany . | |
| 2920347 | 11/1980 | Fed. Rep. of Germany | 102/489 |

*Primary Examiner*—Charles T. Jordan
*Assistant Examiner*—Ted L. Parr
*Attorney, Agent, or Firm*—William C. Anderson

[57] ABSTRACT

Apparatus for deploying one or more submissiles (15) from a carrier missile (25) whereby each submissile (15) is deployed into a flight path which is initially parallel to a streamline (20) of the fluid flow contiguous to the carrier missile (25). An ejection mechanism (45) has a submissile support member (105) oriented substantially parallel to the streamline (20) at the point where the submissile (15) is separated from the support member (105). The ejection mechanism (45) also provides a minimum side force to the submissile (15) which is proportional to a speed of the carrier vehicle (25). Provisions are also made to reduce or minimize any change in the aerodynamic characteristics of the carrier missile (25) after a submissile (15) has been deployed.

19 Claims, 21 Drawing Figures

FIG. 8
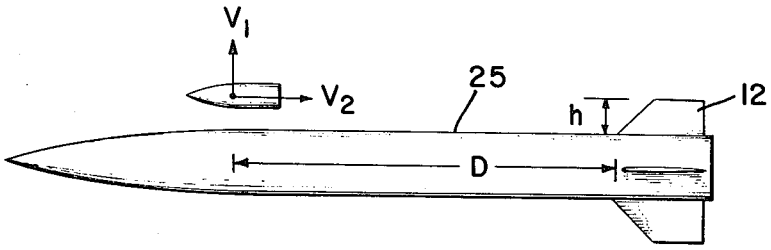
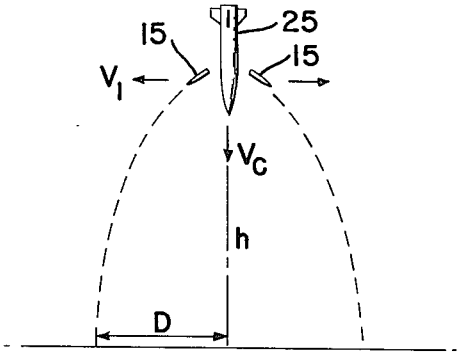
FIG. 9
FIG. 10
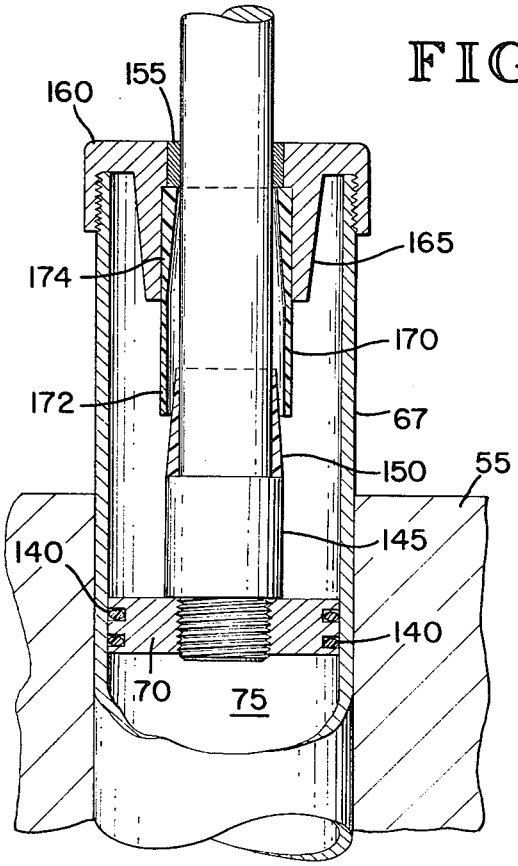
FIG. 11
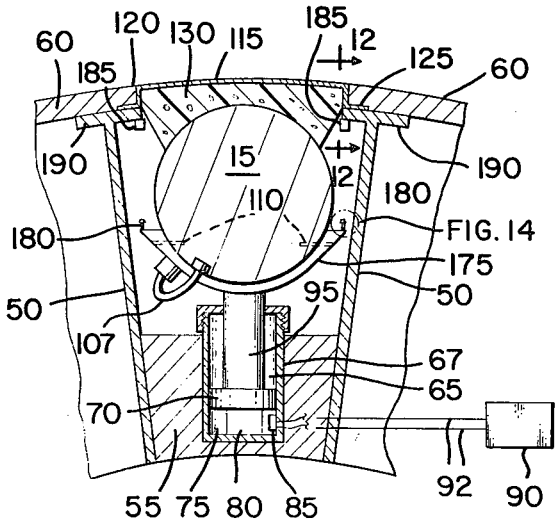

FIG. 12
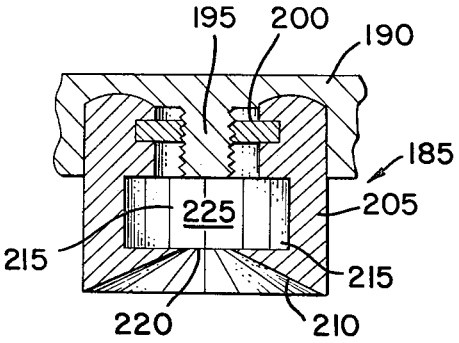
FIG. 14
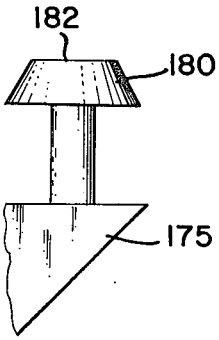
FIG. 13
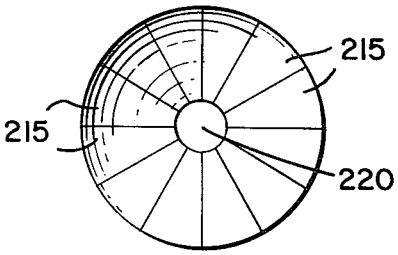
FIG. 15
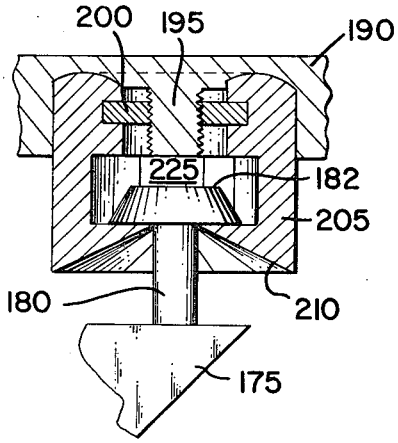
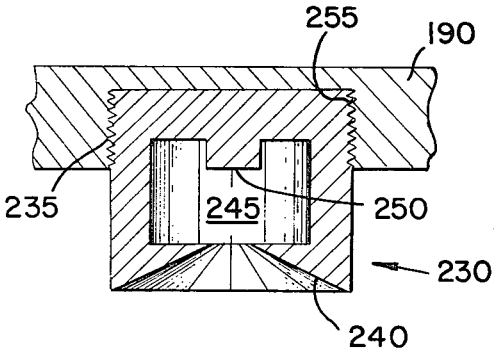
FIG. 16

FIG. 17
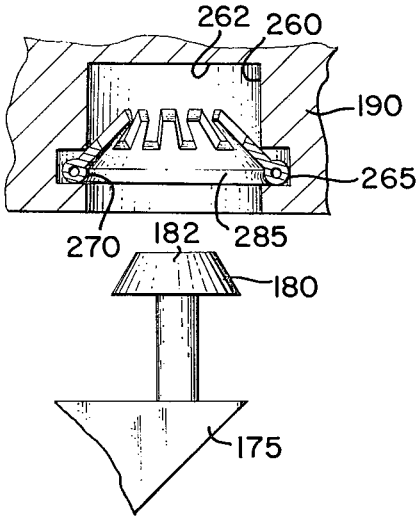
FIG 18
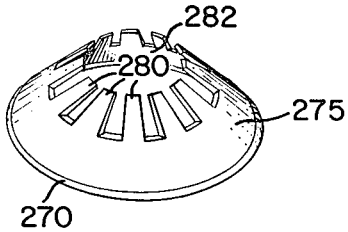
FIG. 19
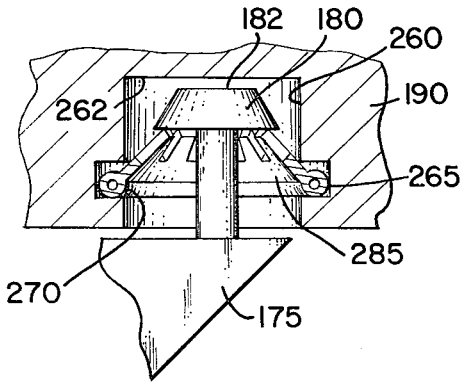
FIG. 20
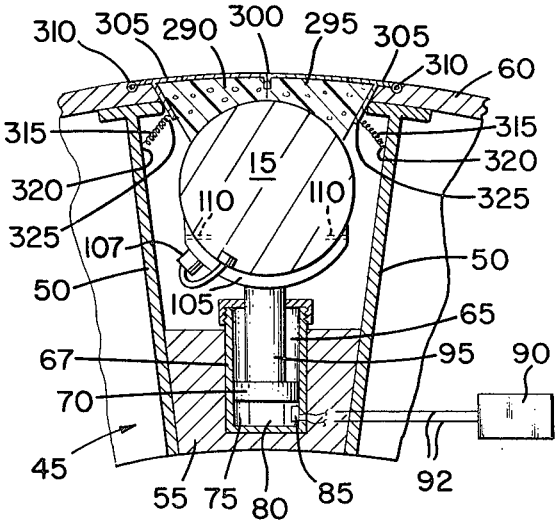
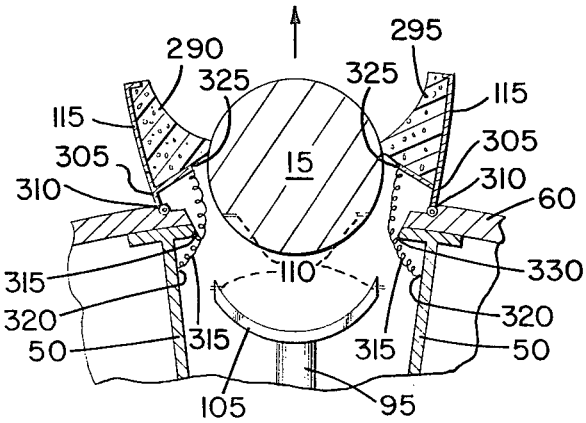
FIG. 21

MISSILE DEPLOYMENT APPARATUS

CROSS REFERENCE TO RELATED APPLICATIONS

This application is related to U.S. Pat. No. 4,372,216 issued Feb. 8, 1983 to G. T. Pinson et al.

TECHNICAL FIELD

This invention relates to the deployment of a body from another body moving in a fluid stream. More particularly this invention relates to a system for ejecting a submissile from a carrier missile.

BACKGROUND OF THE INVENTION

Recently offensive carrier missile systems have been developed that are capable of carrying multiple warheads or submissiles each of which may be deployed and independently controlled to arrive at a selected target. Such a system must controllably eject each submissile whereby the submissile may be initially placed or deployed from a stowed postion within the carrier missile to an operative position in a predetermined and controllable trajectory or flight path.

Certain forces influence the deployment of a submissile from the carrier missile. For example, the aerodynamic forces surrounding the carrier missile can cause a deployed submissile to perform large amplitude oscillations. Even if the submissile is provided with internal flight controls, these oscillations may cause the submissile to depart from the desired flight path. In a worst case, the unpredictable flight path of the submissile may lead to an in-flight collision with the carrier missile possibly leading to mutual destruction. Other factors including, e.g., the size of the submissile, speed of the carrier missile and whether the submissile is provided with its own guidance and control system must be considered.

BRIEF SUMMARY OF THE INVENTION

The present invention provides an apparatus for deploying a body from a stowed position within a moving carrier vehicle to an operative position initially parallel to a high velocity fluid stream contiguous the carrier vehicle. The apparatus comprises a deployment assembly attached to the vehicle and a plurality of body ejection mechanisms housed within the deployment assembly. Each of the ejection mechanisms has a body support member having an axis oriented substantially parallel to the fluid stream. In operation a means attached to the body support member imparts a motion to the body substantially perpendicular to the vehicle fluid stream.

BRIEF DESCRIPTION OF THE DRAWINGS

FIG. 8 shows some of the parameters to consider to insure proper deployment of a submissile having an internal guidance and control system.

FIG. 9 shows some of the parameters to consider to insure proper deployment of a submissile not having an internal guidance and control system.

FIG. 10 illustrates the cross-section of a tapered stop useful in the present invention.

FIG. 11 illustrates the partial cross-sectional view of an alternative ejection mechanism using a pin lock.

FIG. 12 is a partial cross-sectional view of a pin lock taken along line 12—12 in FIG. 11.

FIG. 13 is an end view of the pin lock of FIG. 12.

FIG. 14 is an enlargement of a view designated in FIG. 11.

FIG. 15 illustrates the cooperation of a pin of FIG. 14 with the flexible latch member illustrated in FIG. 12.

FIG. 16 illustrates a preferred pin lock.

FIG. 17 is a cross-sectional view of another alternative pin lock.

FIG. 18 is a detailed view of the pin lock of FIG. 17.

FIG. 19 is a view illustrating the cooperation of a pin with the pin lock of FIG. 17.

FIGS. 20 and 21 are operational views of a preferred embodiment of an ejection mechanism of the present invention.

DETAILED DESCRIPTION OF THE INVENTION

Figure 1:
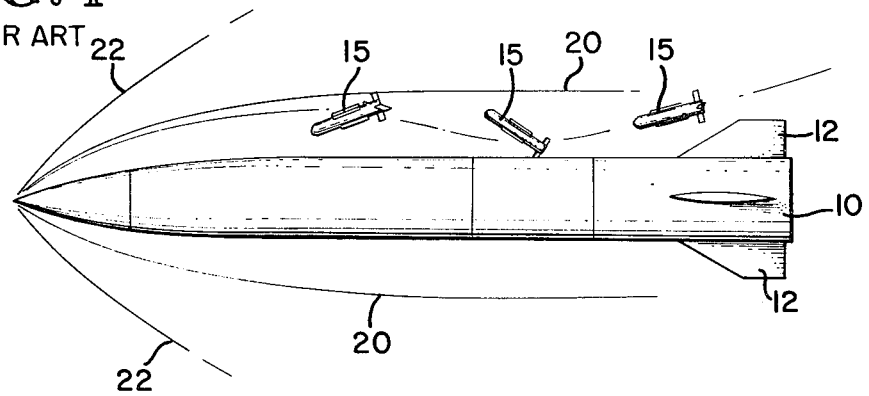
FIG. 1 PRIOR ART
FIG. 1 is a general illustration of some of the problems solved by the present invention.

Referring now to the drawings wherein like reference characters designate identical or corresponding parts throughout several views, and more particularly to FIG. 1 thereof wherein problems solved by the present invention are illustrated. In FIG. 1 a carrier vehicle or missile 10 having a plurality of fins 12 is shown as having ejected (by a means not shown) a body or a submissile 15 into the fluid stream 20 contiguous to the carrier missile 10. Also shown is a shock wave 22 having a downstream turbulent high-pressure zone.

In practice, the submissile deployment apparatus of the present invention avoids ejecting submissiles into the turbulent high-pressure fluid stream proximate the shock wave 22 because of the extreme difficulty of deploying submissiles into stable trajectories in such an environment. In fact, even avoiding the shock wave 22, a submissile 15, if not initially deployed into a predefined and carefully controlled predictable trajectory after it leaves the carrier missile, may suffer oscillations such as is shown in FIG. 1 leading to probable impact between the submissile and the carrier missile. As can be well understood, these impacts, in a worst case, may cause mutual destruction of the carrier missile and submissile or may prevent the submissile from reaching its preselected target. Even if the submissile 15 is provided with an internal guidance and control system, the magnitude of the aerodynamic forces operating upon the submissile may prevent the establishment of a stable flight path in the vicinity of the carrier missile. Consequently, it has been found to be very important to place the submissile in an initial flight path substantially parallel to the streamlines of the fluid stream contiguous the carrier missile 10.

Figure 2:
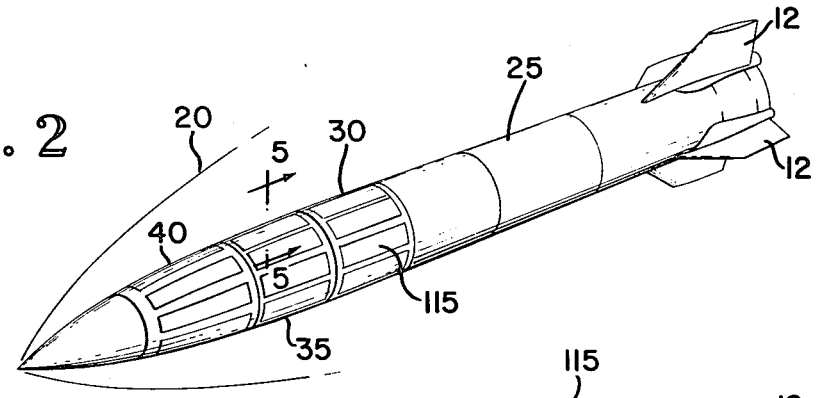
FIG. 2 is a schematic view of a carrier missile embodying the principles of the present invention.

The present invention provides an apparatus for deploying one or more submissiles 15, by a carrier missile 25, in a safe and predictable manner wherein a submissile 15 is ejected from the carrier missile 25 and initially deployed in a fluid stream parallel to the local fluid streamlines adjacent the carrier missile. In FIG. 2 the carrier missile 25 is shown as having a plurality of deployment assemblies 30, 35 and 40 whereby one (FIG. 3) or more (FIG. 4) submissiles 15 may be given an initial flight path parallel to a streamline of the fluid stream contiguous the carrier missile 10.

Figure 5:
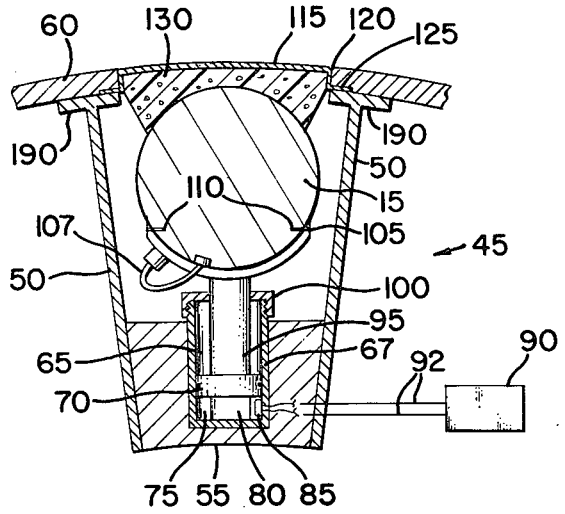
FIG. 5 is a partial sectional view taken along line 5—5 in FIG. 2.

Disposed about the longitudinal axis of each deployment assembly (e.g. assembly 35) is a plurality of identical submissile ejection mechanisms 45 (only one of which is shown in FIG. 5). Each mechanism 45 comprises a pair of partition walls 50 attached at one end to an ejection mechanism support 55 connected by a means (not shown) to the main body of the carrier missile 25. The other end of each of the walls 50 is attached to the covering or aerodynamic skin 60 of the deployment assembly 35 by means of a pair of brackets 190.

Figure 3:
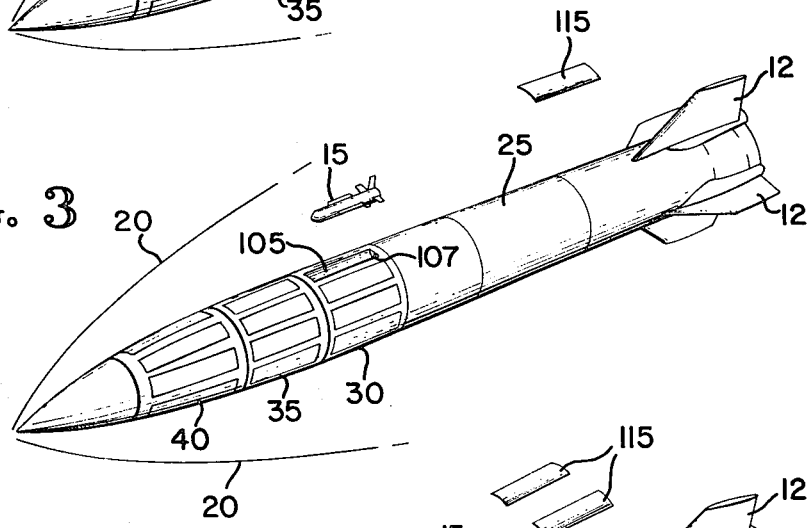
FIG. 3 shows a single submissile being deployed by the carrier missile.
Figure 4:
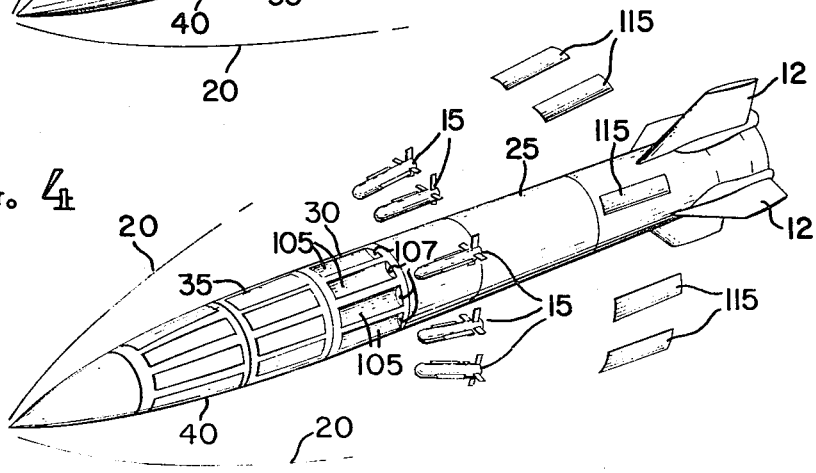
FIG. 4 shows a plurality of submissiles being deployed by the carrier missile.

A cavity or an expansion chamber 65 is defined within the support 55 by means of a chamber sleeve or a cylinder 67. Positioned within the cavity 65 is a piston head 70 having seals (not shown) whereby an expansible chamber 75 may be defined. The expansible chamber 75 is provided with a source of motive fluid, e.g., an explosive or high speed gas generating charge 80. The charge 80 may, for example, be ignited by an ignition initiator or a squib 85. A suitable controller 90 may, for example, be electrically connected to the squib 85 using electrical leads 92. When desired, the controller 90 sends a signal along the leads 92 to a preselected squib 85 whereby a submissile 15 is ejected and thereby deployed as illustrated in FIG. 3. Of course, a plurality of submissiles 15 may be similtaneously deployed, as is illustrated in FIG. 4, using the controller 90.

A piston rod 95, connected at one end to the piston head 70, is constrained for vertical translation substantially perpendicular to the fluid stream contiguous the carrier missile 25 by means of a piston rod guide and stop 100. The stop 100 may, for example, be threadedly connected to the cylinder 67 and performs a function which will be described hereinafter. The other end of the piston rod 95 is connected to a submissile support member or a saddle 105. The saddle 105 supports a submissile 15 in its stowed position and is fixed thereto by means of any conventional application oriented constraint, such as, for example a plurality of shear pins 110. The saddle 105 is oriented substantially parallel to the fluid stream contiguous to the carrier missile 25, as will be better understood hereinafter. If the submissile 15 is provided with electronic equipment such as an internal guidance and control system, the saddle may be provided with a means 107 whereby the carrier missile may provide (e.g., electrically) the submissile with any desired information, e.g., control, guidance and target information, prior to and during ejection of the submissile.

An aerodynamic panel 115 is positioned within a porthole or a body ejection passageway 120 formed in the skin 60 of the assembly 35. A pair of lips 125 fit between the brackets 190 and the undersurface of the skin 60 whereby the panel 115 may be affixed to the assembly 35 when the submissile 15 is in its stowed position. A compressible material or a foam 130 is juxtaposed between the skin 115 and the submissile 15 whereby the submissile 15 may be further secured in its stowed position. Any conventional attachment means (not shown) affixes the foam 130 to the panel 115.

In operation, the controller 90 sends a signal along the leads 92 to the squib 85 whereby the explosive charge 80 is ignited. The motive fluid resulting from the rapid combustion of the charge forces the piston head 70 upwardly causing the piston rod 95 to translate vertically to its fullest upward stroke (not shown). Concomitantly, the saddle 105 moves vertically causing the submissile 15 to compress the foam material 130 and force the lips 125 out of their engagement with the undersurface of the skin 60. As is shown in FIGS. 3 and 4, as a submissile is ejected, the aerodynamic panel 115 is quickly removed allowing the submissile 15 to be ejected and deployed into a position which is substantially parallel to the local fluid stream 20.

Figure 6:
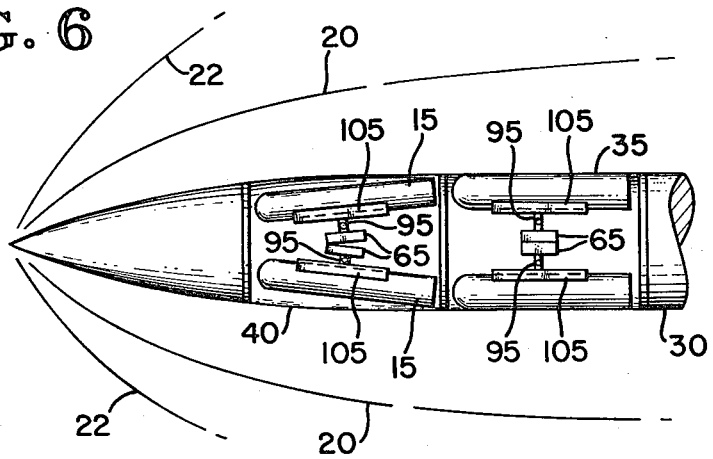
FIG. 6 depicts the relationship between an ejection mechanism useful in the present invention and the fluid stream contiguous the carrier missile.
Figure 7:
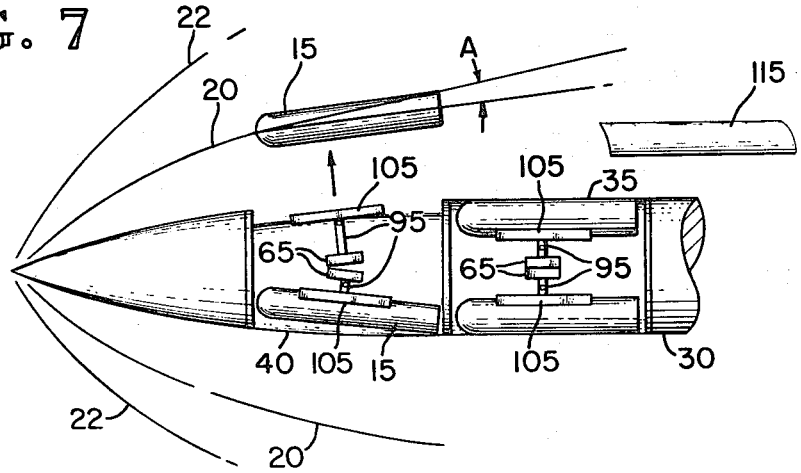
FIG. 7 illustrates the relationship between an intially deployed submissile and the fluid stream contiguous the carrier missile.

The deployment of a submissile is shown more clearly in FIGS. 6 and 7 wherein a cross-sectional view of the deployment assemblies 35 and 40 is shown. For the sake of simplicity, only the expansion chamber 65, the piston rod 95 and the saddle 105 are shown. A submissile 15 in the stowed position is illustrated in FIG. 6 while FIG. 7 shows a deployed submissile. It is important to note that the saddle 105 should preferably be parallel or substantially parallel to the local fluid stream at the full upward stroke of the piston rod 95, i.e., at the point where the submissile 15 is separated from the saddle 105. Since the local flow pattern around the carrier missile 10 will change as the velocity of the carrier missile 10 varies, it is difficult to insure that a saddle 105 will deploy a submissile 15 into an initial flight path that is perfectly parallel with the local fluid flow. Consequently, it is important to understand that there may be a misalignment of the submissile 15 relative to the local fluid stream defined herein in terms of an angle A (see FIG. 7). However, if deployment is desired at a known speed, the angle A can be minimized. If deployment is desired over a wide range of speeds, the angle A can be minimized by designing the deployment angle based on dynamic pressure considerations.

In practice, the worst case dynamic pressure condition occurs at a mach number (M) of about 1.5. At $M=1.5$ the pressure characteristics of the aerodynamic fluid stream contiguous the carrier missile 10 are at a maximum rendering it most difficult to properly deploy a submissile 15 as desired herein.

Consequently, when the carrier missile 25 is moving at speeds which are greater than or less than $M=1.5$ a positive or a negative misalignment A will be created. However, A should not be great when using the ejection mechanism of the present invention and any oscillations of the submissile 15 caused by the misalignment A can be minimized by either the aerodynamic characteristics of the submissile 15 and/or an internal guidance and control system (not shown) disposed within the submissile 15.

Another factor to consider that aids in insuring that a submissile 15 is deployed into an initial flight path that is substantially parallel with the fluid stream contiguous the carrier missile 25 is the provision of a minimum radial or side velocity related to the worst case velocity of the carrier missile as defined above. The minimum side velocity is given a direction which is substantially perpendicular to the stream-line proximate the carrier missile 25 and is provided by the ejection mechanism 45. The minimum side velocity is ascertained through the consideration of one or more of the following two primary factors, i.e. a carrier missile structure avoidance requirement and the requirement to eject uncontrolled submissiles (i.e., a submissile having no internal guidance and control system) to a given distance away from the carrier missile allowing the submissile 15 to impact a given target or point.

In the event that the carrier missile 25 deploys one or more submissiles 15, each submissile being provided with an internal guidance and control system, certain parameters, shown in FIG. 8 must be accounted for to obtain the minimum side velocity. The simplified relationship between the minimum side velocity and these parameters is as follows:

$$V_1=(hV_2)/D$$

Where $V_1$=minimum side velocity h=largest structural dimension of the carrier missile 10, e.g. the height of the fins 12.

$V_2$=the speed of the carrier missile 25.

D=the difference between the point of ejection of the submissile 15 from the carrier missile 25 and the location of the largest structural obstacle dimension of the carrier missile 10, e.g., the fins 12.

The above relationship ignores the effect of drag on the submissile which further increases the ejection speed $V_1$ as does the use of the actual dimensions of the submissie 15.

When the carrier missile 25 is given the task of deploying submissiles 15 which are not provided with an internal guidance and control mechanism, the parameters shown in FIG. 9 should be taken into account. In the simplistic illustration of FIG. 9, the submissiles 15 must be deployed at a distance D from the center of impact of the carrier missile 25. In this case, neglecting external forces, the required minimum side velocity ($V_1$) may be ascertained from the following relationship:

$$V_1=(D\ V_c)/h,$$

where

D=the distance from the center of impact of the carrier missile to the impact center of the submissile.

$V_c$=the velocity of the carrier missile.

h=the distance from the target area to the point where a submissile 15 is deployed. Again, the inclusion of other factors such as drag, etc., may substantially increase the required minimum side velocity. However, the basic principles are as illustrated in FIG. 9.

Assuming that a minimum side velocity is imposed on a submissile 15 as it is being ejected from the carrier missile 25, the piston head 70 will strike the stop 100 and momentum will cause the shear pins 110 to break thereby releasing the submissile 15 from its associated saddle 105. At this stage, the saddle 105 will be substantially unconstrained possibly resulting in an undersirable change in the aerodynamic performance of the carrier missile 25. As an alternative to using the stop 100 there is illustrated in FIG. 10 a means to not only control the maximum upward movement of the saddle 105 but also fix the saddle in a position proximate the passageway 120 as shown generally in FIGS. 3 and 4. With the saddle fixed proximate the passageway 120 after deployment of a submissile 15, any change in the aerodynamic characteristics of the carrier missile 10 may be substantially reduced.

In FIG. 10 the piston head 70 is provided with a plurality of seals 140 and is shown as being disposed within the cylinder 67 thereby forming the expansible chamber 75. A piston rod 145, fixed at one end to the piston head 70 and at its other end to a saddle 105 (not shown), is provided with a piston rod ramp surface 150. The surface 150 may be a tapered collar which has been shrunk fit to the rod 145. The piston rod 145 is guided by a bushing 155 which is fastened within a cylinder cap 160 threadably attached to the cylinder 67.

The cylinder cap 160 is provided with an integral cap extension 165 to which is attached a piston stop damping section 170. The section 170 is shown in FIG. 10 as having a guiding section 172 and a ramp section 174. The section 174 wedgingly cooperates with the ramp 150 as the rod 145 is forced upwardly (as viewed in FIG. 10) when motive fluid fills the expansion chamber 75.

During ejection of a submissile 15, the piston rod 145 moves upwardly. Concomitantly, the ramp 150 is guided by the section 172 to the ramp section 174 whereby the motion of the piston rod 145 is slowed and subsequently stopped. As can be understood the ramp 150 will be tightly wedged within the section 174 whereby the saddle 105 may be fixedly disposed proximate the passageway 120. The deceleration of the saddle 105 will be sufficient to break the shear pins 110 allowing the separation of the submissile 15 from its associated saddle.

Another mechanism that may be used to fix a saddle in an upward position proximate the passageway 120 is shown in FIGS. 11 to 15. In FIG. 11 a saddle 175 is provided with expanded distal portions mounting a plurality of pins 180. One of the pins 180 is shown in FIG. 14 as comprising a truncated cone. The pins 180 act as male members cooperating with a corresponding number of female portions or pin locks 185 (see FIG. 12).

The pin locks 185 are attachable to the brackets 190 by means of a threaded bumper head or stop 195 and a internally threaded retainer 200. The retainer 200 is secured within a groove of a flexible latch member 205. The latch member 205 is a substantially cylindrical member provided at its pin-receiving portion with a ramp surface 210 formed by a plurality of flexible fingers 215 (see FIG. 13). Each of the fingers 215 terminate forming a orifice 220 leading to a receptacle 225.

In use, as a submissile 15 is being ejected through a passageway 120, the pins 180 are forced into contact with the ramp surfaces 210 eventually passing through the orifices 220 into the receptacles 225 (see FIG. 15) whereby the pins are held within the receptacles 225. Consequently, the saddle 175 may be fixed proximate the passageway 120 whereby any changes in the aerodynamic characteristics of the carrier missile 10 may be reduced. The stop 195 acts as a bumper coacting with the upper surface 182 of the pin 180 as the pin 180 is forced into the receptacle 225 thereby aiding in the provision of the shear force necessary to break the shear pins 110 and cause separation of a submissile 15 from its associated saddle 175.

Optionally, an integral threaded insert 230 may be provided (see FIG. 16). The insert 230 is provided with threads 235 on its exterior surface and a ramp surface 240 comparable to the surface 210. The integral insert 230 is also provided with a receptacle 245 and a bumper stop 250. The threaded insert 230 may be received in a cavity 255 formed in the brackets 190.

Another embodiment fixing a saddle proximate the ejection passageway 120 is illustrated in FIGS. 17–19. FIG. 17 shows one of a plurality of pin receiving cavities 260 that may be formed in the brackets 190. Each cavity 260 is provided with a groove 265 forming a support for a rolled edge 270 of a metal spring 275 disposable within each cavity 260. As can be ascertained from FIGS. 17 and 18, the metal spring 275 has the general shape of a hollow truncated cone. The spring 275 is provided with an orifice 282 and a plurality of flexible fingers or tines 280. The interior surface 285 of the spring 275 acts as a ramp surface whereby when any pin 180 is forced into contact with the ramp surface 285, the tines 280 are forced outwardly allowing the pin 180 to enter the orifice 282 and pass into the cavity 260. Once the pin 180 passes through the orifice 282 the tines 280 return to their unflexed, original position and lock the pin 180 in the closed position shown in FIG. 19. The inner surface 262 of the cavity 260 performs the same function as the stops 195, 250.

The piston head stop illustrated in FIG. 10 and the pin locks illustrated in FIGS. 11 to 19 fix a saddle proximate the passageway 120, as illustrated generally in FIGS. 3 and 4. Consequently, these saddle lock mechanisms are useful in reducing changes in the aerodynamic characteristics of the carrier missile 25. The changes are attributable to the obvious fact that the configurations of the saddles 105, 175 do not match the configuration of the skin 60. Additionally, the fluid contiguous the carrier missle 25 may enter the missile 10 at the ends 107 (see FIGS. 3 and 4) of the saddle 105 or 175 which do not cooperate with the skin 60. FIGS. 20 and 21 illustrate a more preferred embodiment wherein changes in the aerodynamic characteristics of a carrier missile are substantially minimized.

FIG. 20 shows a submissile 15 attached to a saddle 105 by means of a plurality of shear pins 110. As with the embodiment of FIG. 5 a piston rod 95 forms part of an ejection mechanism 45. In the embodiment of FIG. 20 an aerodynamic panel comprises a first aerodynamic panel 290 and a second aerodynamic panel 295 bounded by a central separation plane 300. Each aerodynamic panel 290, 295 is attached to the skin of a deployment assembly by means of a hinge plate 305 and a hinge 310. The panels 295 and 300 are maintained in an abutting contact with each other and with the submissile 15 by means of a plurality of springs 315. The springs 315 are fixed at their distal ends at 320 on the partitions 50 and at 325 on the panels 290 and 295.

In operation, as a submissile 15 is being ejected through the passageway 120 by means of the ejection mechanism 45, the saddle 105 forceable contacts bumper stops (not shown but which may be positioned proximate the brackets 190) thereby aiding in breaking the shear pins 110 (see FIG. 21). As the submissile 15 moves through the passageway 120, the panels 290 and 295 are forced outwardly along the hinge axis of the hinge 310. After the submissile clears the panels 290 and 295, the springs 315 force the panels 290 and 295 back into a closed position, illustrated in FIG. 20. Consequently, after the panels 290, 295 return to their original position the aerodynamic characteristics of the carrier missile 25 are maintained.

Obviously numerous modifications and variations of the above described invention are possible in light of the above teachings. For example, the pins 180 may be fixed to the brackets 190 and the pin locks 185 or 230 may be affixed to the saddle 175. It is also obvious that the deployment apparatus of the present invention is useful not only with carrier missiles but may also be useful with any moving carrier vehicle, such as, for example, aircraft, etc.

What is claimed as new and desired to be secured by Letters Patent of the United States is:

1. Apparatus for deploying a body from a stowed position within a moving carrier vehicle to an operative position intially parallel to a high velocity fluid stream contiguous said carrier vehicle, comprising:

a deployment assembly provided with an exterior surface covering and being attached to said vehicle, said assembly including means for ejecting at least one body, said ejection means comprising means supporting said body along a longitudinal axis that is oriented substantially parallel to said fluid stream as said body is being ejected;

means cooperating with said body support means for imparting a motion to said body substantially perpendicular to said fluid stream whereby said body may be ejected, said motion imparting means comprising a cavity, a reciprocable piston head mounted within said cavity defining an expansible chamber, a piston rod attached to said piston head and being constrained for translation along an axis substantially perpendicular to said fluid stream, said body support means being attached to said piston rod, and means for providing said chamber with an expansible fluid, and means for holding said body support member against said exterior surface covering after said body has been deployed.

2. The apparatus of claim 1, wherein said motion imparting means capable of imposing is a motion to said body at a velocity proportional to a speed of said vehicle.

3. The apparatus of claim 1, further comprising means for activating said motion imparting means.

4. The apparatus of claim 3, further comprising means for releasing said body from said support member as said body is being ejected.

5. The apparatus of claim 4, further comprising a displaceable panel covering said body in its stowed position, said displaceable panel being removed as said body is being ejected.

6. The apparatus of claim 5, wherein said displaceable panel forms a portion of said exterior surface covering and said deployment assembly is provided with means for holding said displaceable panel fixed relative to said exterior surface covering when said body is in its stowed position.

7. The apparatus of claim 6, wherein said displaceable panel holding means comprising compressible means, said compressible means being juxtaposed between said displaceable panel and said body when said body is in its stowed position, and releasable lips formed on said displaceable panel, said lips coacting with said exterior surface covering when said body is in its stowed position.

8. The apparatus of claims 1 or 7, including means for electrically connecting said body to said body support means.

9. The apparatus of claim 6, wherein said displaceable panel comprises a first and a second section, each section being hinged at one end to said exterior surface covering, means for biasing said first section and said second section into a mutually abutting contact and into contact with said body when said body is in a stowed position, whereby when said body is being ejected, said sections may be rotated about their hinge axes and said body may be deployed, whereafter said sections may be rotated by said biasing means into said mutually abutting contact.

10. The apparatus of claim 9, wherein said biasing means comprises springs.

11. The apparatus of claim 1, wherein said support means holding means comprises a ramp surface attached to said translatable piston rod, means defining a damping surface spaced from and opposed to said ramp surface for stopping the motion of said translatable piston rod as said body is being ejected and means for supporting said damping surface defining means within said cavity.

12. The apparatus of claim 1, wherein said support means holding means comprises a plurality of pins, each of said pins being a truncated cone cooperating with a corresponding number of pin locks.

13. The apparatus of claim 12, wherein each of said pin locks comprise a cylindrical member, said cylindrical member having a plurality of flexible locking fingers defining a guiding surface and an orifice, said guiding surface leading one of said pins through said orifice to a receptacle disposed within said cylindrical member as said body is being ejected whereby said fingers lock said pin within said receptacle.

14. The apparatus of claim 12, wherein each of said pin locks comprise a truncated member, said truncated member having a ramp surface, said ramp surface defined by a pluraltiy of flexible locking tines, said tines defining an orifice, whereby said flexible tines lock a pin within said orifice as said body is being ejected.

15. The apparatus of claims 12, 13 or 14, wherein said pins are fixed to said body support member and said pin locks are fixed, in an opposing relationship, to said exterior covering.

16. The apparatus of claims 12, 13 or 14, wherein said pins are fixed to said exterior covering and said pin locks are fixed, in an opposing relationship, to said body support member.

17. The apparatus of claim 1, wherein a displaceable panel, forms said portion of said exterior surface covering and covers said body in its stowed position, said displaceable panel being removed as said body is being ejected.

18. Apparatus for deploying a body from a stowed position within a moving carrier vehicle to an operative position initially parallel to a high velocity fluid stream contiguous said carrier vehicle, comprising:

a deployment assembly provided with an exterior surface covering and being attached to said vehicle, said assembly including means for ejecting at least one body, said ejection means comprising means supporting said body along a longitudinal axis of said body support means that is oriented substantially parallel to said fluid stream as said body is being ejected;

a displaceable panel, forming a portion of said exterior surface covering, said panel covering said body in its stowed position and being removable as said body is being ejected, said displaceable panel comprising a first and a second section, each section being hinged at one end to said exterior surface covering;

means for biasing said first section and said second section into a mutually abutting contact and into contact with said body when said body is in a stowed position, whereby when said body is being ejected, said sections may be rotated about their hinge axes and said body may be deployed, whereafter said sections may be rotated by said biasing means into said mutually abutting contact, and means cooperating with said body support means for imparting a motion to said body substantially perpendicular to said fluid stream whereby said body may be ejected.

19. The apparatus of claim 18, wherein said biasing means comprises springs.

* * * * *